US008316501B1

(12) United States Patent
Martin, III et al.

(10) Patent No.: US 8,316,501 B1
(45) **Date of Patent: *Nov. 27, 2012**

(54) TUBULAR CLEANING DEVICE

(75) Inventors: John C. Martin, III, Katy, TX (US); Louis P. Vickio, Jr., Houston, TX (US); Harold Wilson, Jr., Beckville, TX (US); James V. Young, Jr., Missouri City, TX (US)

(73) Assignee: Blue Water Pipeline Solutions, LLC, Katy, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/053,906

(22) Filed: Mar. 22, 2011

Related U.S. Application Data

(60) Provisional application No. 61/316,578, filed on Mar. 23, 2010.

(51) Int. Cl.
*B08B 9/04* (2006.01)

(52) U.S. Cl. ..... 15/104.061; 15/104.05; 134/167 R

(58) Field of Classification Search ..... 134/168 C, 134/167 C, 167 R, 168 R; 15/3.5, 104.03, 15/104.04, 104.05, 104.061
See application file for complete search history.

(56) References Cited

U.S. PATENT DOCUMENTS

| | | | | |
|---|---|---|---|---|
| 2,913,053 | A * | 11/1959 | Westbrook | 166/152 |
| 5,086,842 | A | 2/1992 | Cholet | |
| 6,374,838 | B1 * | 4/2002 | Baugh | 134/167 C |
| 6,776,231 | B2 * | 8/2004 | Allen | 166/173 |
| 7,979,944 | B1 * | 7/2011 | Martin et al. | 15/104.061 |
| 2004/0118565 | A1 * | 6/2004 | Crawford | 166/312 |
| 2005/0045210 | A1 | 3/2005 | Baugh | |

* cited by examiner

*Primary Examiner* — Saeed T Chaudhry
(74) *Attorney, Agent, or Firm* — Buskop Law Group, PC; Wendy Buskop

(57) ABSTRACT

One or more tubular cleaning devices and methods for cleaning a tubular are provided herein. The tubular cleaning device can include an inner tubular member having an inner tubular member inner bore formed therethrough. The inner tubular member can include a housing formed on a first portion thereof, a first connection end adjacent the housing, and a second connection end opposite the first connection end.

8 Claims, 10 Drawing Sheets

TUBULAR CLEANING DEVICE

CROSS REFERENCE TO RELATED APPLICATIONS

The present application claims priority to and the benefit of U.S. Provisional Patent Application Ser. No. 61/316,578 filed on Mar. 23, 2010, entitled "TUBULAR CLEANING DEVICE", which is incorporated herein in its entirety.

FIELD

The present embodiments generally relate to a tubular cleaning device.

BACKGROUND

A need exists for a tubular cleaning device that has a shorter length than typical tubular cleaning devices and can maneuver or pass through sharp bends in a tubular.

A further need exists for a tubular cleaning device that can be adapted to be used with different heads depending on the application of the tubular cleaning device.

There is also a great need for a tubular cleaning device that allows for full bore return throughout the tubular and that is less subject to plugging.

A further need exists for a tubular cleaning device that does not depend on a decrease or increase in pressure to reverse direction.

The present embodiments meet these needs.

BRIEF DESCRIPTION OF THE DRAWINGS

The detailed description will be better understood in conjunction with the accompanying drawings as follows.

Figure 1:
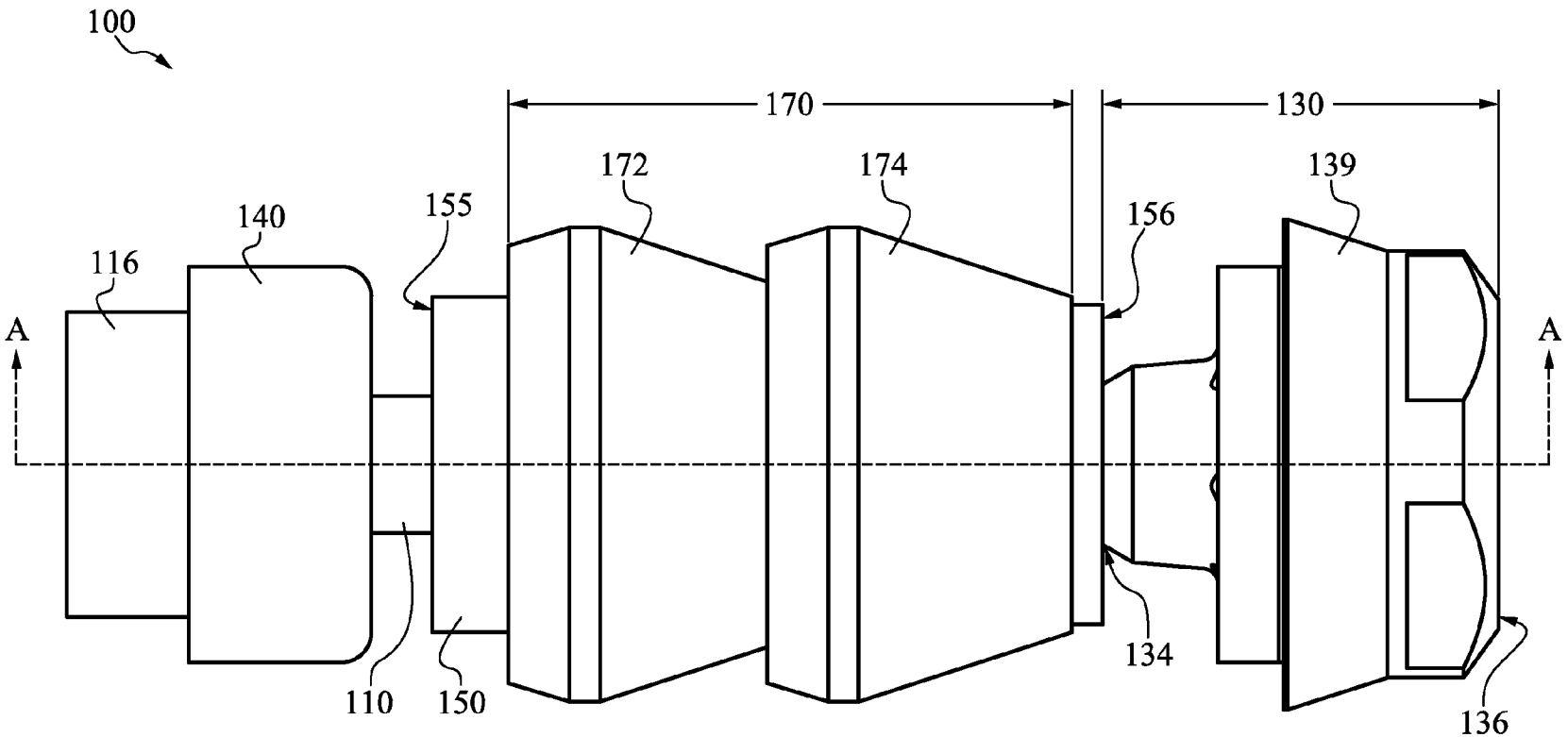
FIG. 1 depicts a side view of an illustrative tubular cleaning device according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a tubular cleaning device.

One or more embodiments of the tubular cleaning device can include an inner tubular member having an inner tubular member inner bore formed therethrough.

The inner tubular member can include a housing formed on a first portion thereof.

The inner tubular member can also have a first connection end adjacent the housing and a second connection end opposite the first connection end.

In one or more embodiments, a housing seal can be formed into the housing. The housing seal can be configured to prevent flow through a flow path when the outer tubular member is abutting the housing.

In one or more embodiments, a plug can be secured to the housing. The plug can be configured to prevent flow through the flow path when the outer tubular member is abutting the housing.

A nozzle having a first nozzle end can be connected to the second connection end. For example, the first nozzle end can be threaded to the second connection end.

The nozzle can have a nozzle inner bore. The nozzle inner bore can be in fluid communication with the inner tubular member inner bore. The nozzle inner bore can provide a flow path from the first nozzle end to a second nozzle end.

An outer tubular member can be slidably disposed about the inner tubular member. A flow path can be formed through the outer tubular member. The flow path can provide fluid communication between a first end of the outer tubular member and a second end of the outer tubular member. The flow path can be in an opened position when the outer tubular member is abutting the first nozzle end and in a closed position when the outer tubular member is abutting the housing.

A seal can be disposed about the outer tubular member. In one or more embodiments of the tubular cleaning device, the outer tubular member can have a groove formed in an exterior portion thereof. The seal can be disposed within the groove. The seal can be an elastomeric seal. In one or more embodiments, the seal can include one or more conical portions. A conical portion can be at least partially disposed about another conical portion. An outer diameter of the seal can be larger than an outer diameter of the nozzle.

The nozzle can have one or more through holes formed therethrough. The through holes can be isolated from the nozzle inner bore. The through holes can provide a flow path between the first nozzle end and the second nozzle end.

In one or more embodiments, a nozzle seal can be disposed about the nozzle. The nozzle seal can be a flexible elastomeric moveable wear bushing. In embodiments, the nozzle can have an outer diameter with or without a nozzle seal that is smaller then the seal disposed about the outer tubular member.

Turning now to the Figures, FIG. 1 depicts a side view of an illustrative tubular cleaning device according to one or more embodiments.

A tubular cleaning device 100 is depicted having an inner tubular member 110, an outer tubular member 150 disposed about the inner tubular member 110, a seal 170 disposed about the outer tubular member 150, and a nozzle 130 connected to the inner tubular member 110.

The inner tubular member 110 can have a housing 140. The housing 140 can be adjacent a first connection end 116 of the inner tubular member 110.

The housing 140 can be configured to operatively engage at least a first end 155 of the outer tubular member 150.

The seal 170 can be disposed between the first end 155 and a second end 156 of the outer tubular member 150. The seal 170 can have one or more portions; for example, as depicted, the seal 170 can have two conical shaped portions 172 and 174.

The nozzle 130 can be connected to the inner tubular member 110. The nozzle 130 can have a nozzle seal 139 disposed about it. The nozzle seal 139 can be a bushing, an elastomeric seal, or similar sealing device. The nozzle 130 can have a first nozzle end 134 and a second nozzle end 136.

Figure 2:
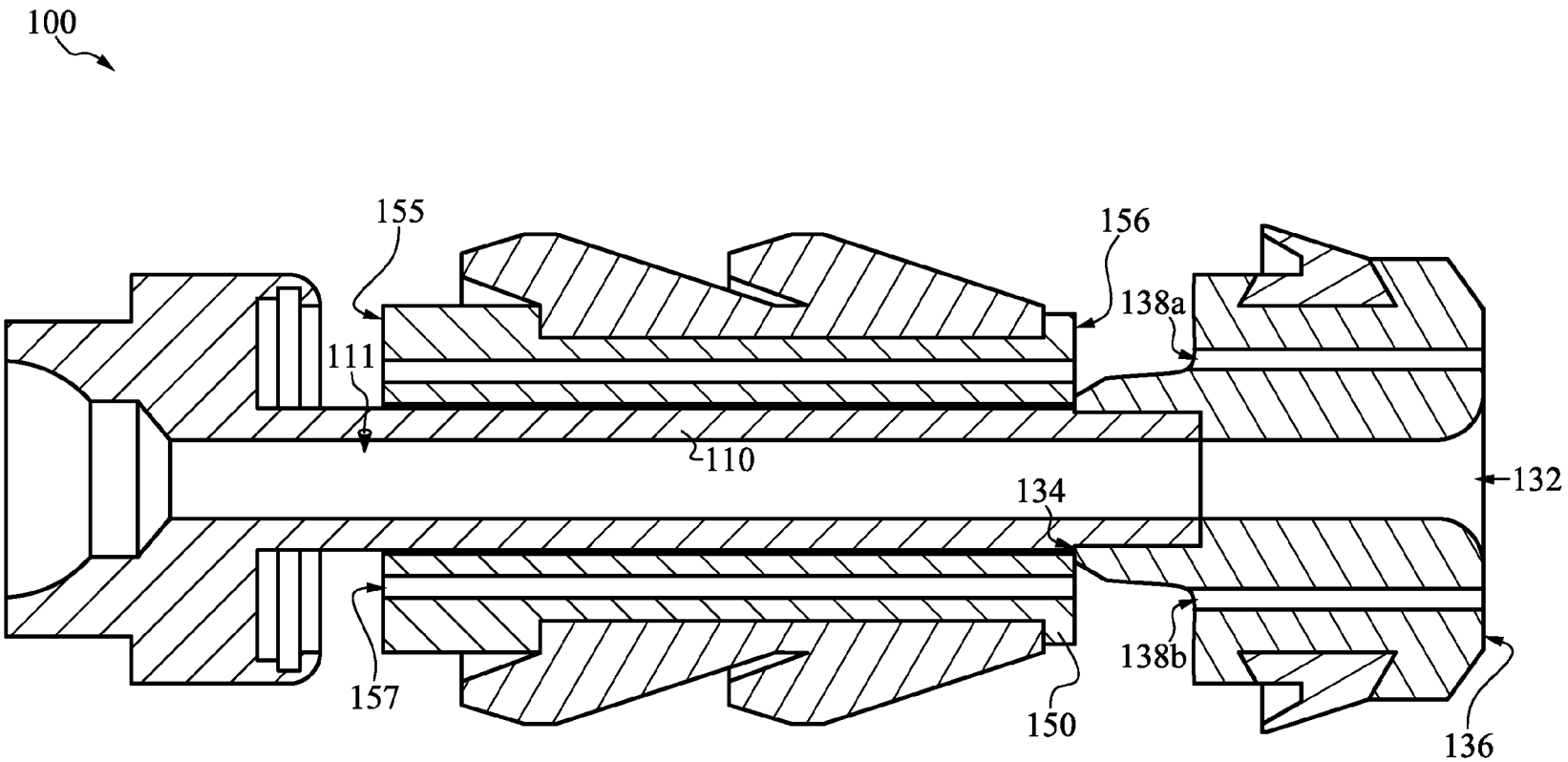
FIG. 2 is a cross sectional view along line A-A of FIG. 1 when the tubular cleaning device is in a first configuration according to one or more embodiments.

FIG. 2 is a cross sectional view along line A-A of FIG. 1 when the tubular cleaning device of FIG. 1 is in a first configuration according to one or more embodiments.

One or more flow paths or orifices 157 can be formed through the outer tubular member 150. The flow paths 157 can provide fluid communication between the first end 155 and the second end 156 of the outer tubular member 150.

A nozzle inner bore 132 can provide a flow path from the first nozzle end 134 to the second nozzle end 136. One or more through holes 138*a* and 138*b* can provide a flow path from the first nozzle end 134 to an area adjacent the second nozzle end 136. The through holes 138*a* and 138*b* can provide one or more flow paths that are isolated from the nozzle inner bore 132.

The inner tubular member 110 can have an inner tubular inner bore 111 that is in fluid communication with the nozzle inner bore 132. The second end 156 of the outer tubular member 150 can engage or sit proximate to the first nozzle end 134 when the tubular cleaning device 100 is in the first configuration.

Figure 3A:
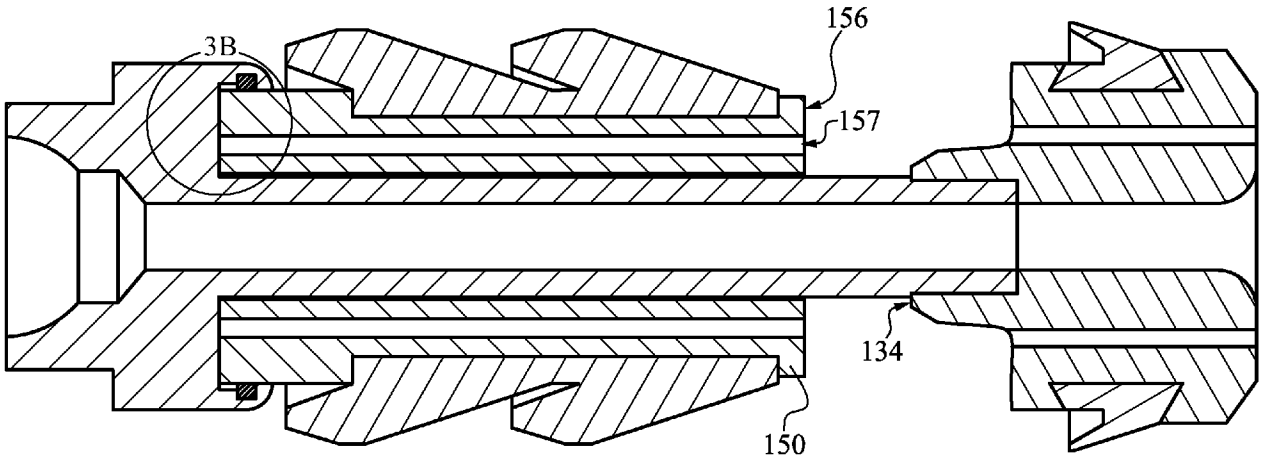
FIG. 3A is a cross sectional view along line A-A of FIG. 1 when the tubular cleaning device is in a second configuration according to one or more embodiments.
Figure 3B:
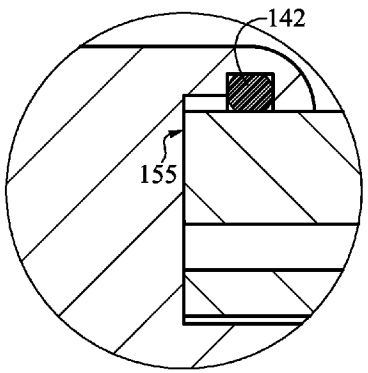
FIG. 3B is a detailed view of a portion of a housing when the tubular cleaning device of FIG. 1 is in the second configuration according to one or more embodiments

FIG. 3A is a cross sectional view along line A-A of FIG. 1 when the tubular cleaning device of FIG. 1 is in a second configuration according to one or more embodiments. FIG. 3B is a detailed view of a portion of the housing when the tubular cleaning device of FIG. 1 is in the second configuration according to one or more embodiments.

Referring to FIGS. 1, 3A, and 3B, the second end 156 of the outer tubular member 150 can be removed or distal from the first nozzle end 134 when the tubular cleaning device 100 is in the second configuration.

In addition, the first end 155 of the outer tubular member 150 can be engaged with a housing seal 142 within the housing 140 when the tubular cleaning device 100 is in the second configuration. Accordingly, fluid can be prevented from exiting or entering the flow path 157 adjacent the first end 155 of the outer tubular member 150 when the tubular cleaning device 100 is in the second configuration.

The housing seal 142 can be formed in an inner diameter of the housing 140. The housing seal 142 can have one or more elastomeric seals disposed thereon. In one or more embodiments, the housing seal 142 can be configured to provide a metal seal. Accordingly, the housing seal 142 can be a metal seal, an elastomeric seal, a non-elastomeric seal, a composite seal, a glass seal, or any other type of seal.

Figure 4:
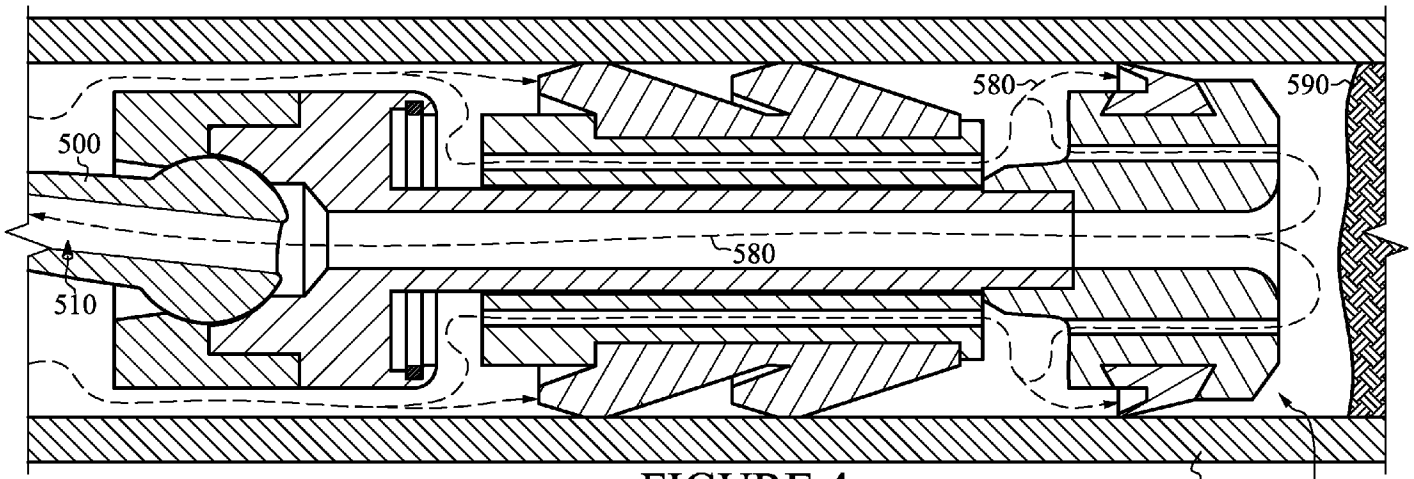
FIG. 4 depicts a schematic of the tubular cleaning device of FIG. 1 being inserted into a pipeline according to one or more embodiments.

FIG. 4 depicts a schematic of the tubular cleaning device of FIG. 1 being inserted into a pipeline according to one or more embodiments. Referring to FIGS. 1, 2, and 4, the operation of the tubular cleaning device 100 can be explained more clearly.

The tubular cleaning device 100 can be attached to a tubing string 500. The tubing string 500 can have a tubing string inner bore 510 that is in fluid communication with the inner tubular inner bore 111.

After the tubing string 500 is shown connected to the tubular cleaning device 100, for example, at the first connection end 116, the tubular cleaning device 100 can be inserted into a pipeline 550. The pipeline 550 can be a down hole tubular, a surface pipeline, a subsea pipeline, an underground pipeline, or combinations thereof.

The tubular cleaning device 100 can be moved within the pipeline 550 by flowing a fluid 580 within the pipeline 550, for example, within an annulus formed between the pipeline 550 and the tubing string 500. The fluid 580 can apply a force upon the seal 170 and move the outer tubular member 150 until the second end 156 of the outer tubular member 150 engages the first nozzle end 134. The force applied to the seal 170 by the fluid 580 can also move or urge the tubular cleaning device 100 along the pipeline 550.

The fluid 580 can flow from the first end 155 of the outer tubular member 150 to the second end 156 of the outer tubular member 150 via the flow path 157. The fluid 580 can then flow through the through holes 138*a* and 138*b* to an area adjacent the second nozzle end 136.

A clog or a closed section 590 within the pipeline 550 can cause a pressure differential within the pipeline 550 and force the fluid 580 to travel from the pipeline 550 to the surface via the nozzle inner bore 132, the inner tubular inner bore 111, and the tubing string inner bore 510. The fluid 580 can penetrate or remove a portion of the clog 590.

After a certain period of time, or upon completion of a task, it may be desirable to reverse the tubular cleaning device 100 out of the pipeline 550.

Figure 5:
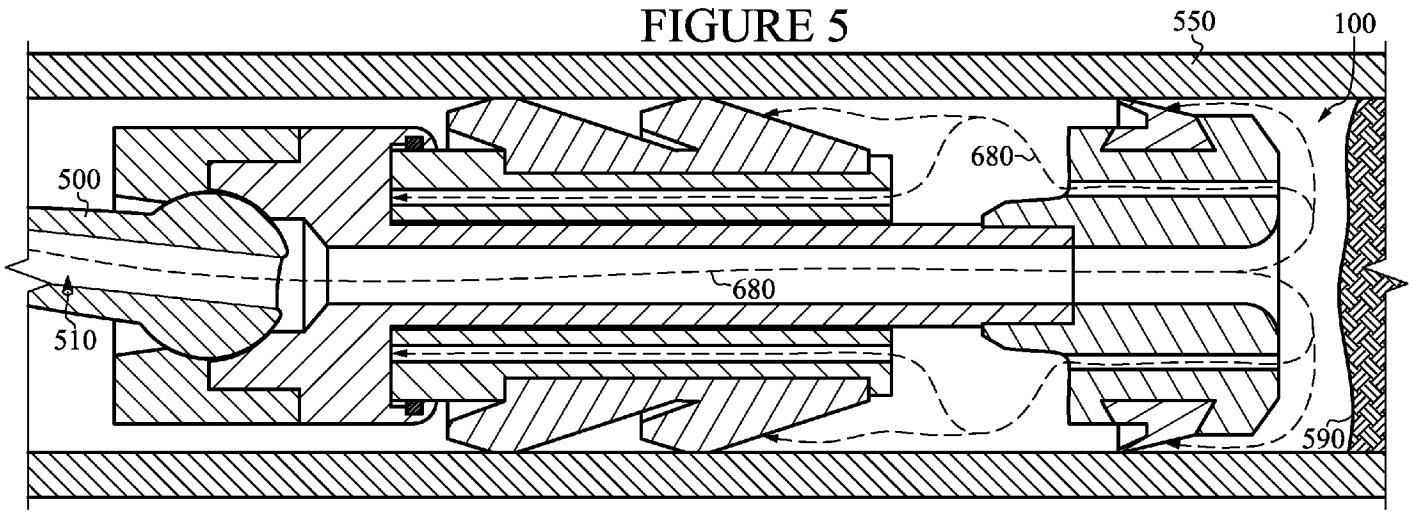
FIG. 5 depicts a schematic of the tubular cleaning device of FIG. 1 being removed from the pipeline of FIG. 4 according to one or more embodiments.

FIG. 5 depicts a schematic of the tubular cleaning device of FIG. 1 being removed from the pipeline of FIG. 4 according to one or more embodiments. Referring to FIGS. 2, 3A, 3B, and 5, the reverse operation of the tubular cleaning device can be explained more clearly.

The tubular cleaning device 100 can be placed in the second configuration by flowing fluid 680 down the tubing string inner bore 510 to the nozzle inner bore 132 via the inner tubular inner bore 111.

The fluid 680 can exit the nozzle inner bore 132 into the pipeline 550 having the clog 590, and the pressure difference within the pipeline 550 can cause the fluid 680 to flow into the through holes 138*a* and 138*b*. The fluid 680 exiting the through holes 138*a* and 138*b* can exert a force on the seal 170 and move the outer tubular member 150 until the first end 155 engages the housing seal 142. Since fluid communication from the first end 155 and the second end 156 is prevented, the fluid 680 can force the tubular cleaning device 100 out of the pipeline 550 by applying force to the seal 170.

The fluid 580 discussed in FIG. 4 and the fluid 680 discussed in FIG. 5 can be the same fluid or different fluids. For example, the fluids 580 and 680 can be one or more of water, ethanol, corrosion inhibiters, or another fluid.

Figure 6:
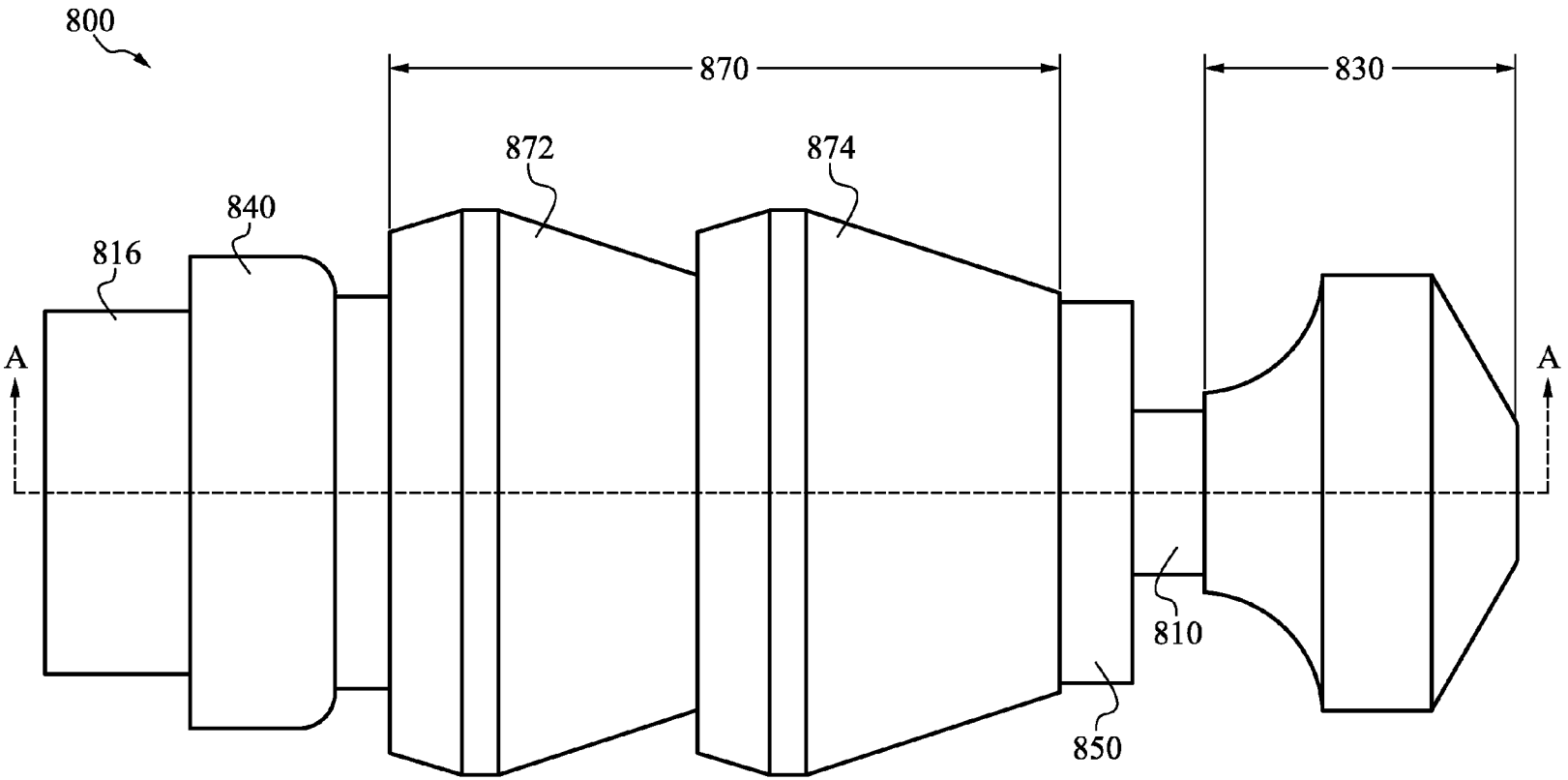
FIG. 6 is a side view of another illustrative tubular cleaning device according to one or more embodiments.

FIG. 6 is a side view of another illustrative tubular cleaning device according to one or more embodiments.

The illustrative tubular cleaning device 800 can include an outer tubular member 850, one or more seals 870 disposed about the outer tubular member 850, a first connection end 816 of an inner tubular member 810, a housing 840, and a nozzle 830.

In one or more embodiments, the seal 870 can be an elastomeric seal. The seal 870 can have two conical portions 872 and 874.

Figure 7:
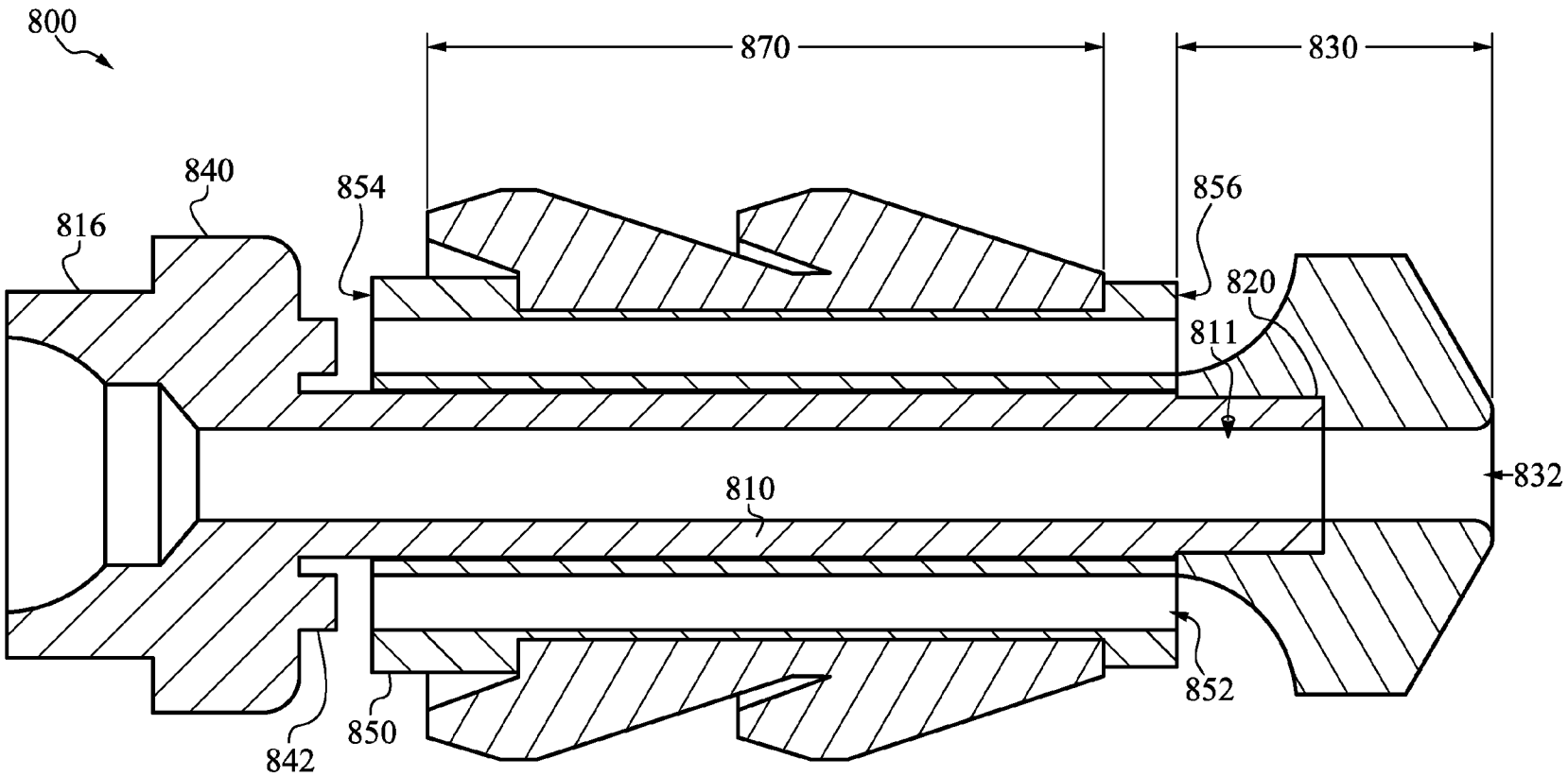
FIG. 7 depicts a cross sectional view of the illustrative tubular cleaning device of FIG. 6 along line A-A when the tubular cleaning device is in a first configuration according to one or more embodiments.

FIG. 7 depicts a cross sectional view of the illustrative tubular cleaning device of FIG. 6 along line A-A when the tubular cleaning device is in a first configuration according to one or more embodiments.

The outer tubular member 850 can have one or more flow paths 852 formed therethrough. The flow paths 852 can provide fluid communication between a first end 854 and a second end 856.

The outer tubular member 850 can move about the inner tubular member 810. The inner tubular member 810 can have an inner bore 811 formed therethrough. The inner bore 811 can provide fluid communication between the first connection end 816 of the inner tubular member 810 and a second connection end 820 of the inner tubular member 810.

The nozzle 830 can have an inner nozzle bore 832 formed therethrough. The inner nozzle bore 832 can be in fluid communication with the inner bore 811 of the inner tubular member 810 to provide a flow path through the nozzle 830.

When the tubular cleaning device 800 is in a first configuration, the second end 856 of the outer tubular member 850 can abut or engage the nozzle 830. When the second end 856 of the outer tubular member 850 is engaged with the nozzle 830, fluid communication between the second end 856 and the first end 854 of the outer tubular member 850 is provided by the flow paths 852. One or more plugs 842 can be on the housing 840. Also shown is the seal 870.

Figure 8:
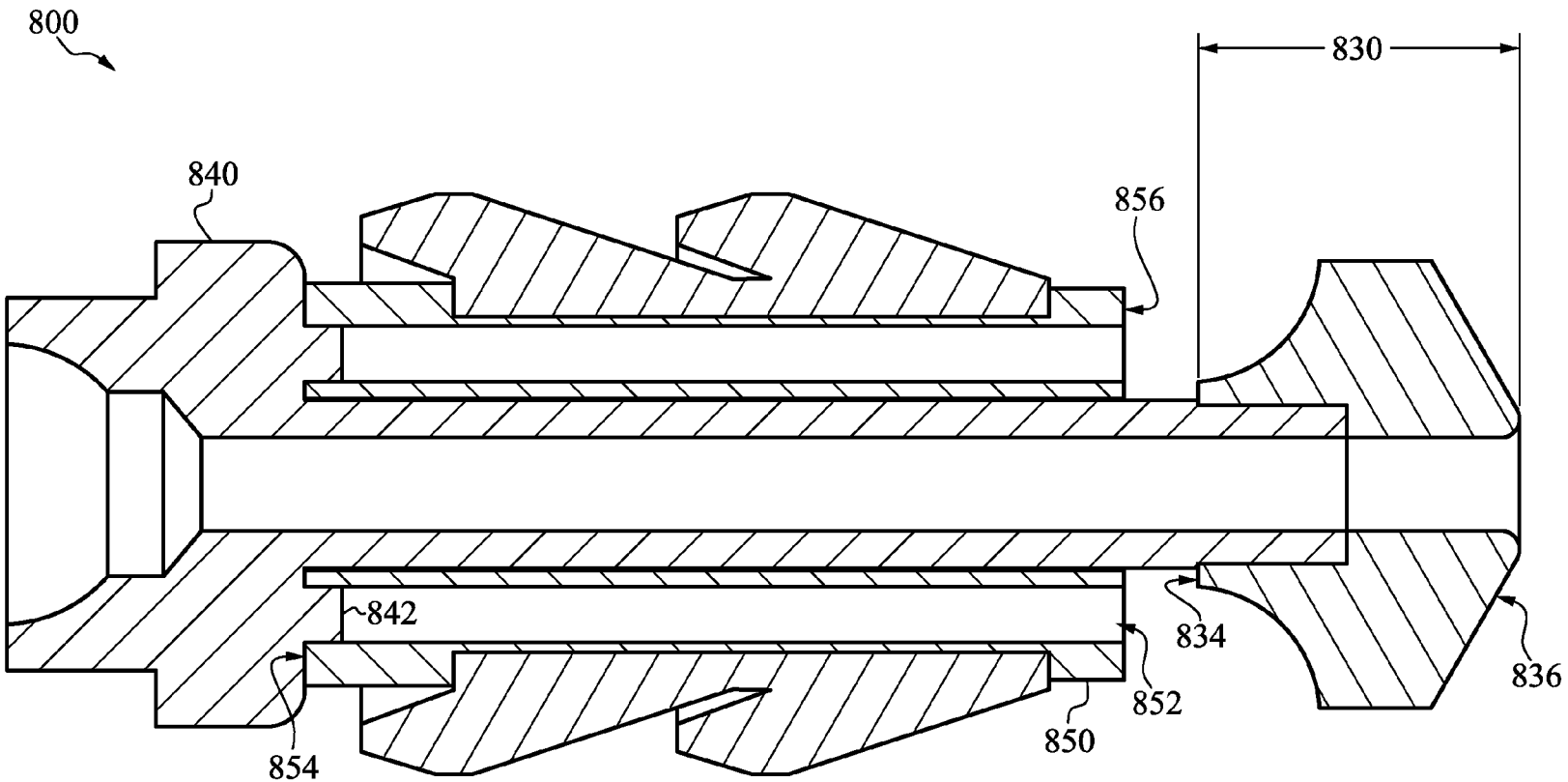
FIG. 8 is a cross sectional view along line A-A of FIG. 6 when the tubular cleaning device is in a second configuration according to one or more embodiments.

FIG. 8 is a cross sectional view along lines A-A of FIG. 6 when the tubular cleaning device is in a second configuration according to one or more embodiments.

Referring to FIGS. 6 and 8, the first end 854 of the outer tubular member 850 can engage the housing 840 when the tubular cleaning device 800 is in the second configuration.

One or more plugs 842, which can be on the housing 840, can plug or seal a portion of the flow paths 852 when the outer tubular member 850 is engaged with the housing 840. Accordingly, fluid can be prevented from entering or exiting the flow paths 852 adjacent the first end 854 when the tubular cleaning device 800 is in the second configuration.

The nozzle 830 can have an outer diameter that is smaller than the outer diameter of the seal 870. Accordingly, fluid can flow from a first nozzle end 834, adjacent the second end 856, to a second nozzle end 836. The fluid can flow about the outer diameter of the nozzle 830.

Figure 9:
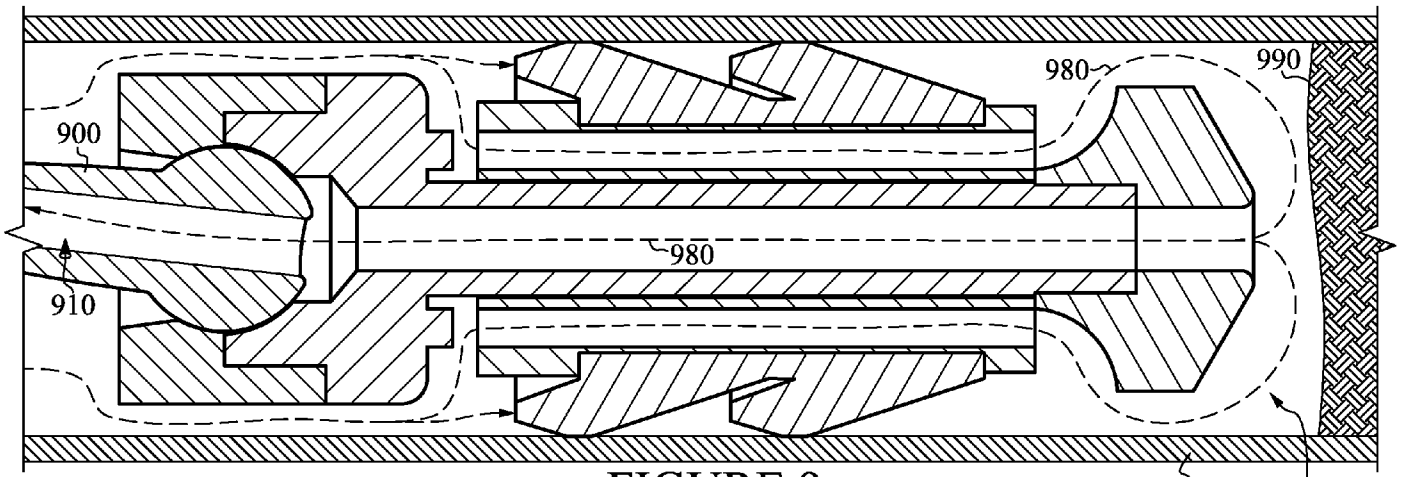
FIG. 9 depicts a schematic of the tubular cleaning device of FIG. 6 being inserted into a pipeline according to one or more embodiments.

FIG. 9 depicts a schematic of the tubular cleaning device of FIG. 6 being inserted into a pipeline according to one or more embodiments. Referring to FIGS. 7, 8, and 9, a tubing string 900 having a tubing string inner bore 910 can be connected to the first connection end 816 of the inner tubular member 810.

After the tubing string 900 is connected to the tubular cleaning device 800, the tubular cleaning device 800 can be inserted into a pipe 950. Fluid 980 can be pumped or provided to the inner diameter of the pipe 950.

The fluid 980 can apply a force to the seal 870 and move the outer tubular member 850 towards the nozzle 830. Accordingly, the force applied by the fluid 980 can place the tubular cleaning device 800 in the first configuration, and fluid 980 can flow from the first end 854 of the outer tubular member 850 to the second end 856 of the outer tubular member 850 via the flow paths 852.

The fluid 980 can exit the flow paths 852 adjacent the second end 856 of the outer tubular member 850 adjacent the first nozzle end 834. The fluid 980 can then flow between the nozzle 830 and the inner diameter of the pipe 950 to the second nozzle end 836. A pressure build up in the pipe 950, for example, caused by a clog 990, can force the fluid 980 into the nozzle inner bore 832. The fluid 980 can flow out of the pipe 950 via the inner bore 811 and tubing string inner bore 910.

Figure 10:
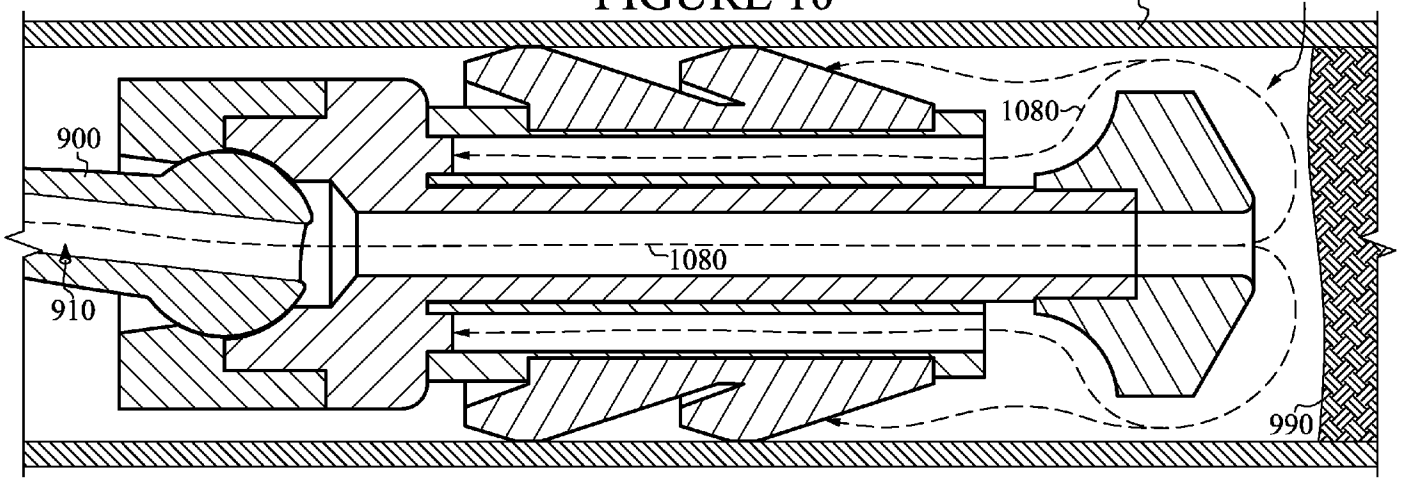
FIG. 10 depicts a schematic of the tubular cleaning device of FIG. 6 being removed from the pipeline of FIG. 9 according to one or more embodiments.

FIG. 10 depicts a schematic of the tubular cleaning device of FIG. 6 being removed from the pipeline of FIG. 9 according to one or more embodiments. Referring to FIGS. 7, 8, and 10, after a period of time, after a task is completed, or for some other reason, it may be desirable to reverse the tubular cleaning device 800 out of the pipe 950.

This can be accomplished by flowing fluid 1080 to the nozzle 830 via the inner bore 811 and the tubing string inner bore 910 of the tubing string 900. The fluid 1080 can flow from the first nozzle end 834 to the second nozzle end 836 via the nozzle inner bore 832.

The pressure build up in the pipe 950, for example due to the clog 990, can cause the fluid 1080 to flow between the inner diameter of the pipe 950 and the outer diameter of the nozzle 830. The fluid 1080 can apply a force to the seal 870. The force applied to the seal 870 can move the outer tubular member 850 towards the housing 840.

The plugs 842 can plug the flow path 852 and prevent the fluid 1080 from exiting the flow path 852 adjacent to the first end 854 of the outer tubular member 850. The force applied to the seal 870 can move the tubular cleaning device 800 within the pipe 950 and reverse the tubular cleaning device 800 out of the pipe 950. Of course, force can be applied through the tubing string 900 to help reverse the tubular cleaning device 800 out of the pipe 950.

Figure 11:
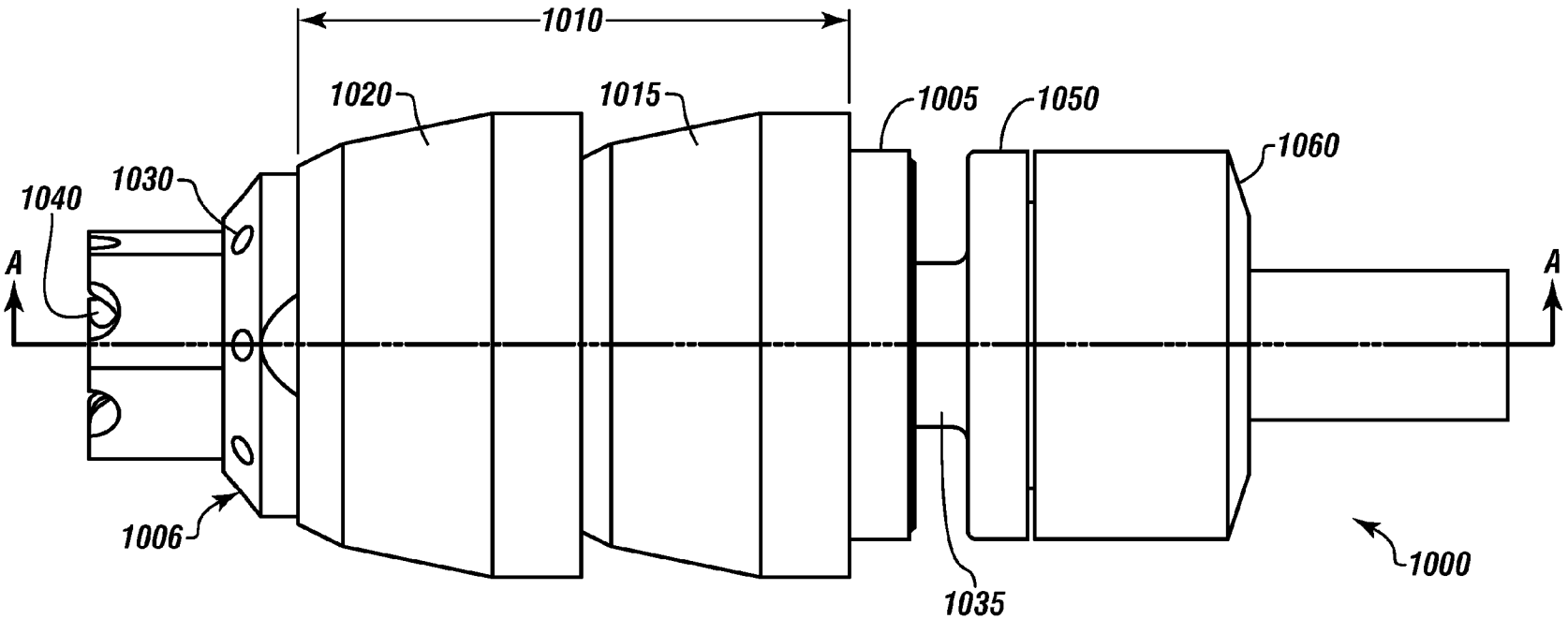
FIG. 11 depicts an isometric view of another tubular cleaning device according to one or more embodiments.
Figure 12:
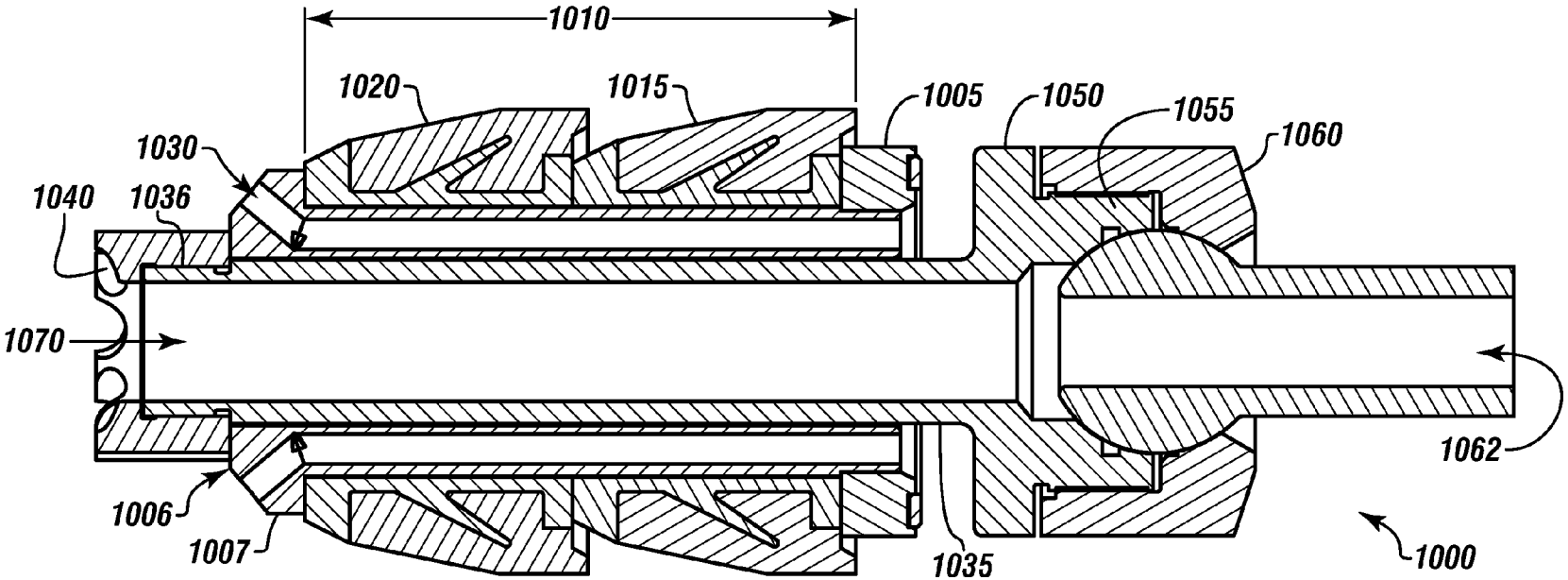
FIG. 12 depicts a cross sectional view along line A-A of FIG. 11 of the tubular cleaning device.

FIG. 11 depicts an isometric view of another tubular cleaning device according to one or more embodiments. FIG. 12 depicts a cross sectional view of the tubular cleaning device of FIG. 11 cut along line A-A.

Referring to FIGS. 11 and 12, the tubular cleaning device 1000 can include an inner tubular member 1035 and an outer tubular member 1007. The outer tubular member 1007 can be disposed about the inner tubular member 1035.

The outer tubular member 1007 can have a seal 1010 disposed thereabout. The seal 1010 can include conical portions 1020 and 1015. The seal 1010 can be similar to ones described herein.

The outer tubular member 1007 can include one or more through holes 1030 formed therethrough, which can be or include nozzles. An end piece can be disposed on a second connecting end 1036 of the inner tubular member 1035. The end piece can include holes 1040.

The inner tubular member 1035 can have a housing 1050. The housing 1050 can be adjacent a first connecting end 1055. The housing 1050 can be part of the first connecting end 1055. A second end 1005 of the outer tubular member 1007 can abut or engage the housing 1050 as the outer tubular member is in a second position.

A tubing string 1060 can connect to the first connecting end 1055. The tubing string 1060 can include a tubing string inner bore 1062 in fluid communication with an inner tubular member inner bore 1070.

While these embodiments have been described with emphasis on the embodiments, it should be understood that within the scope of the appended claims, the embodiments might be practiced other than as specifically described herein.

What is claimed is:

1. A tubular cleaning device comprising:

a. an inner tubular member having an inner tubular member inner bore formed therethrough, wherein the inner tubular member comprises:

(i) a housing formed on a first portion thereof;

(ii) a first connection end adjacent the housing; and (iii) a second connection end opposite the first connection end;

b. an end piece disposed on the end of the inner tubular member;

c. an outer tubular member slidably disposed about the inner tubular member;

d. a flow path formed through the outer tubular member, wherein the flow path formed through the outer tubular member provides fluid communication between a first end of the outer tubular member and a second end of the outer tubular member, wherein the flow path formed through the outer tubular member is in an opened position when the outer tubular member is abutting the end piece; and e. a seal disposed about the outer tubular member, wherein an outer diameter of the seal is larger than an outer diameter of the end piece.

2. The tubular cleaning device of claim 1, wherein the outer tubular member has a groove formed in an exterior portion thereof, and wherein the seal is disposed within the groove.

3. The tubular cleaning device of claim 1, wherein the seal is an elastomeric seal.

4. The tubular cleaning device of claim 1, wherein the seal comprises a first conical portion at least partially disposed about a second conical portion.

5. The tubular cleaning device of claim 1, wherein the flow path formed through the outer tubular member is in a closed position when the outer tubular member is abutting the housing.

6. The tubular cleaning device of claim 1, further comprising a housing seal formed into the housing, wherein the housing seal is configured to prevent flow through the flow path formed through the outer tubular member when the outer tubular member is abutting the housing.

7. A tubular cleaning device comprising:

a. an inner tubular member having an inner tubular member inner bore formed therethrough, wherein the inner tubular member comprises:

(i) a housing formed on a first portion thereof;

(ii) a first connection end adjacent the housing; and (iii) a second connection end opposite the first connection end;

b. an end piece disposed on the end of the inner tubular member;

c. an outer tubular member slidably disposed about the inner tubular member;

d. a flow path formed through the outer tubular member, wherein the flow path formed through the outer tubular member provides fluid communication between a first end of the outer tubular member and a second end of the outer tubular member;

e. a housing seal formed into the housing, wherein the housing seal is configured to prevent flow through the flow path formed through the outer tubular member when the outer tubular member is abutting the housing; and f. a seal disposed about the outer tubular member, wherein an outer diameter of the seal is larger than an outer diameter of the end piece.

8. A tubular cleaning device comprising:

a. an inner tubular member having an inner tubular member inner bore formed therethrough, wherein the inner tubular member comprises:

(i) a housing formed on a first portion thereof;

(ii) a first connection end adjacent the housing; and (iii) a second connection end opposite the first connection end;

b. an end piece disposed on the end of the inner tubular member;

c. an outer tubular member slidably disposed about the inner tubular member;

d. a flow path formed through the outer tubular member, wherein the flow path formed through the outer tubular member provides fluid communication between a first end of the outer tubular member and a second end of the outer tubular member, wherein the flow path formed through the outer tubular member is in a closed position when the outer tubular member is abutting the housing; and e. a seal disposed about the outer tubular member, wherein an outer diameter of the seal is larger than an outer diameter of the end piece.

* * * * *